US005341537A

United States Patent [19]

Curtis et al.

[11] Patent Number: 5,341,537

[45] Date of Patent: Aug. 30, 1994

[54] PLAQUE REMOVING TOOTHBRUSH

[75] Inventors: John P. Curtis, Bloomsbury; Kedar N. Rustogi, Kendall Park; John C. Crawford, Lake Mahopac; James H. Kemp, North Brunswick; Thomas E. Mintel, Rahway; Bert D. Heinzelman, Tenafly, all of N.J.; Donald R. Lamond, Lynbrook; Laura H. Edelman, New York, both of N.Y.

[73] Assignee: Colgate-Palmolive Company, New York, N.Y.

[21] Appl. No.: 892,655

[22] Filed: Jun. 3, 1992

Related U.S. Application Data

[63] Continuation of Ser. No. 636,802, Jan. 2, 1991, abandoned, which is a continuation-in-part of Ser. No. 501,992, Mar. 29, 1990.

[51] Int. Cl.[5] ..... A46B 9/04

[52] U.S. Cl. ..... 15/167.1; 15/110

[58] Field of Search ..... 15/167.1, 110, DIG. 5, 15/106, 157.1

[56] References Cited

U.S. PATENT DOCUMENTS

| | | | |
|---|---|---|---|
| D. 172,693 | 7/1954 | Wibbelsman | D4/104 |
| 1,382,681 | 6/1921 | Segal | 15/167.1 |
| 2,168,964 | 8/1939 | Strasser | 15/167.1 |
| 2,312,828 | 11/1940 | Adamsson | 15/167.1 |
| 2,429,740 | 10/1947 | Aufsesser | 15/167.1 |
| 2,567,080 | 9/1951 | Pifer | 15/167.1 |
| 3,229,318 | 1/1966 | Clemens | 15/167.1 |
| 3,359,588 | 12/1967 | Kobler | 15/167.1 X |
| 3,722,020 | 3/1973 | Hills | 15/167.1 |
| 4,010,509 | 3/1977 | Huish | 15/167.1 |
| 4,033,008 | 7/1977 | Warren et al. . | |
| 4,051,571 | 10/1977 | Ayers | 15/167.1 |
| 4,268,933 | 5/1981 | Papas | 15/167.1 |
| 4,288,883 | 9/1981 | Dolinsky | 15/167.1 |
| 4,519,111 | 5/1985 | Cavazza | 15/167.1 |
| 4,706,322 | 11/1987 | Nicolas | 15/106 |
| 4,729,142 | 3/1988 | Yoshioka | 15/167.1 |
| 4,776,054 | 10/1988 | Rauch | 15/167.1 |
| 4,802,255 | 2/1989 | Breuer | 15/167.1 X |

FOREIGN PATENT DOCUMENTS

| | | | |
|---|---|---|---|
| 225383 | 10/1943 | Fed. Rep. of Germany | 15/167.1 |
| 683311 | 6/1930 | France | 15/167.1 |

*Primary Examiner*—Timothy F. Simone
*Assistant Examiner*—Patrick F. Brinson
*Attorney, Agent, or Firm*—Robert C. Sullivan; Richard J. Ancel

[57] ABSTRACT

A toothbrush whose tufts comprise three distinct groups of rows, with each row oriented transversely to the longitudinal axis of the head. The tufts of the first group are the shortest. The endmost tufts on each row of the second kind tilt laterally outwardly by about 12 degrees. The tufts of the third group are nearest the end of the head farthest from the handle and diverge from each other. In one embodiment, each tuft of the third kind tilts laterally at an angle of about 30 degrees and forwardly at about 14 degrees. In a first embodiment, each row of the first group comprises a single, wide tuft. In a second embodiment, each row of the first group has a plurality of laterally spaced round tufts. In a third embodiment, each row of the first group comprises a plurality of laterally spaced quadrangular tufts. All of the tufts may also be considered as defining four functional groups of tufts, with each of these four groups performing a specific function during brushing. The arrangement and orientation of the tufts yields a uniform cleaning action substantially independent of brushing direction or technique.

34 Claims, 4 Drawing Sheets

PLAQUE REMOVING TOOTHBRUSH

This is a continuation of copending application Ser. No. 07/636,802 filed on Jan. 2, 1991, now abandoned, which in turn is a continuation-in-part of Ser. No. 07/501,992 filed on Mar. 29, 1990, now issued.

BACKGROUND OF THE INVENTION

This invention relates to a toothbrush and more particularly to a toothbrush having its bristles so arranged as to be effective for the removal of plaque from teeth with manual brushing. The prior art is aware of a number of toothbrush constructions. However none of the latter exhibits a tuft arrangement which performs several tooth and gumline cleaning functions regardless of the style or technique of brushing. A number of toothbrush manufacturers set out specific brushing techniques on their brush containers. If, however, a purchaser does not pay attention to them, or forgets these techniques, then less than optimum teeth cleaning results.

SUMMARY OF THE INVENTION

According to the practice of this invention, the tufts are arranged along the brush head in distinct groups, and preferably in rows, the rows running generally transversely of the longitudinal axis of the head.

Bristles of the individual tufts (each tuft comprising a distinct packet of bristles) are anchored into two types of cavities. Round cavities are generously spaced so as to allow independent and uninhibited movement of each tuft of bristles. Polygonal (typically quadrangular) cavities are closely spaced transversely so as to create continuous linear rows of bristle tips. These polygonal cavities may have rounded or angular corners. Densely spaced tufts typical of prior constructions, tend to move tangentially and thus push each other along as they sweep across tooth surfaces. Generously spaced tufts of this invention move erratically as they negotiate the often irregular contours of tooth crevices.

Each of a first group of tufts is anchored into generally round cavities and includes a center or middle tuft and a pair of laterally outermost tufts, each of which are substantially perpendicular to the surface of the brush head. This group defines interproximal bristles which reach into crevices between teeth. The tufts of this group allow for individual bristle fibers to penetrate tight interproximal spaces and create fans of bristle tips as they are wiped across tooth surfaces. By generally round is meant circular in shape and nearly circular such as elliptical.

Each of a second group of tufts is anchored into polygonal cavities, preferably quadrangular, and most preferably rectangular. There are preferably six or seven tufts, although five or eight tufts can also be used. Each tuft of the second group extends substantially perpendicularly to the surface of the brush head.

Each of a third group of tufts is anchored into generally round cavities and this group includes approximately fourteen tufts positioned along the perimeter of the brush head. Approximately six outermost tufts on each side of the center line of the head tilt laterally outwardly toward the nearest side of the brush head. Two forwardmost tufts (towards the free end of the head) tilt laterally, toward their respective side of the brush head, and also tilt forwardly. These forwardmost tufts which tilt forwardly and laterally may also be considered as a fourth group or as a subgroup of the third group. The perimeter tufts of this group are angled outward from the center line of the brush head so that they project into the gingival marginal area at the base of the crowns of the teeth. This action occurs as downward force is applied to the brush head and is not dependent upon a non-perpendicular orientation of the brush head relative to the tooth surfaces. These perimeter tufts of bristles are angled so that they are unable to structurally support one another as downward and horizontal force is applied by the user.

Conventional, perpendicularly oriented bristle tufts tend to act as a series of columns and thus support suspended bristles as they pass over embrasures. The minimized overall compression strength afforded by this angled configuration allows individual tufts of bristles to penetrate embrasures, sub-gingival and interproximal spaces without being inhibited from doing so by surrounding bristle tufts.

Angled tufts move in the direction of their angle. As downward and horizontal force is applied to the brush head, tufts of bristles skid across tooth surfaces generally in the direction dictated by the angle of the tuft hole in which the bristles are anchored to the brush head rather than simply curl back in the opposite direction in which they are pushed. The construction of this invention is to integrate multi-directional motion of bristles during unidirectional actuation of the brush.

When forced into the direction of their angle, bristles will spring out of crevasses as stresses are exceeded to contain them in place. This dynamic action will tend to fling plaque out of interproximal spaces. Conventional devices tend to pack plaque into spaces as bristle tufts sweep over embrasures.

The weak flexure strength of generously spaced individual bristle tufts allows for the reduction of bristle height without causing the sensation of increased bristle stiffness. Conventional brushes trimmed to the shorter height are perceptibly stiffer and tend to cause trauma to the mucosa. Minimized bristle height allows for greater clearance (and thus enhance reach to the rear molars) between the buccal surfaces of the teeth and the mucosal lining.

Angled tufts of bristles will assume varying heights as they are deformed, yet will be uniform in height when not in use. Angled bristles will project above the tips of straight bristles as the former are forced into a perpendicular orientation during use. This effect, caused by the greater length of the hypotenuse of a triangle, allows for the angled tufts to reach deeply into interproximal and gingival marginal areas as perpendicular orientation is assumed.

Generally round tufts of bristles are preferably trimmed to a taller height than polygonal tufts. This configuration allows for the round tufts of bristles to penetrate interproximal spaces before tooth surfaces contact the bristle tips of polygonal tufts.

Compact linear rows of shorter polygonal tufts uniformly sweep plaque off tooth surfaces without inhibiting adjacent round tufts of bristles from penetrating embrasures.

DETAILED DESCRIPTION OF THE INVENTION

Figure 1:
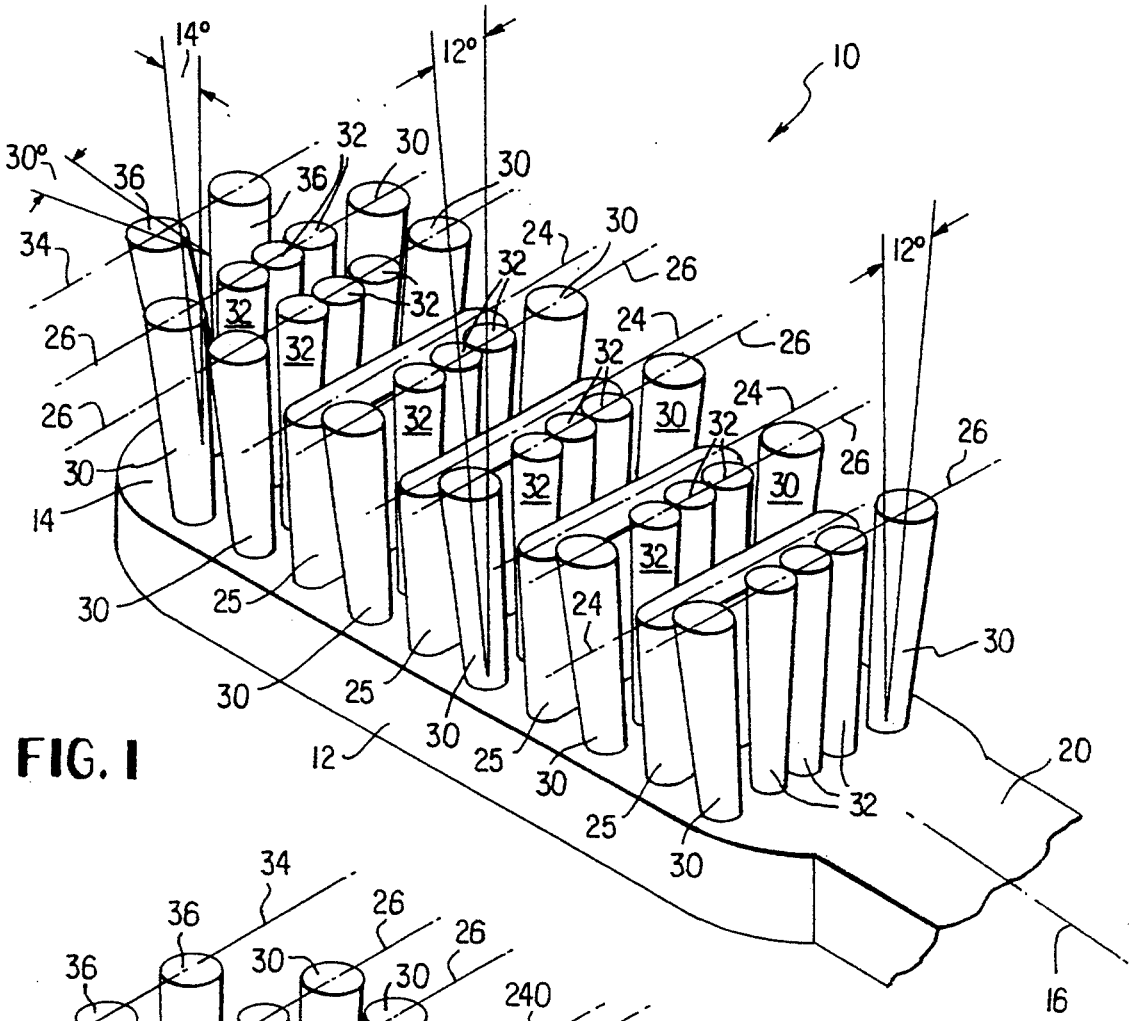
FIG. 1 is a partial perspective view of a toothbrush formed in accordance with a first embodiment of this invention.

Referring now to FIG. 1, the numeral 10 denotes generally the toothbrush of this invention and includes a head 12 having a flat upper surface 14 and a longitudinal axis 16. The head is, typically, integrally joined to a handle 20, with head longitudinal axis 16 not necessarily coincident (as shown) with the longitudinal axis of handle 20, only a portion of the latter being shown. The handle construction forms no part of the invention. Both head 12 and handle 20 may be formed of suitable plastic material such as any of those commonly used.

Any of a first group of polygonal tufts is denoted as 24, with a single wide tuft 25 defining each group, each single wide tuft having its longitudinal axis oriented transversely to axis 16. It will be noted that the bristles in tufts 25 are shorter than those of the bristles in the other groups. All of the groups 24 are parallel to each other and are orthogonal to the axis 16. Tuft 25 is termed a bristle bar or bristle bar of tufts.

A second group of generally round tufts is denoted as 26, each group 26 also oriented transversely to axis 16. The two endmost tufts of row 26 are each denoted as 30, with each such tuft tilting laterally or sideways toward a respective side of head 12, (orthogonally to axis 16) by about 12 degrees with respect to the vertical. The remaining three spaced apart tufts in each group 26, each denoted as 32 and termed interproximal bristles, are substantially perpendicular to surface 14, i.e., vertical. Each tuft 30 is laterally spaced from its next adjacent tuft 32. Tufts 30 and 32 are preferably of the same diameter. The bristles in tufts 30 are termed gumline bristles. Each group 26 thus contains both interproximal and gumline bristles. The groups of round tufts are preferably in rows transverse to the longitudinal axis of head 12.

A third group 34 is defined by two laterally spaced generally round tufts 36. Each tuft 36 tilts laterally toward its respective side of the brush head by about 30 degrees. Each tuft 36 also tilts with respect to a plane which contains it, about 14 degrees to the vertical. Thus each tuft 36 tilts both laterally and forwardly toward the free end of the head. Tufts 36 are termed leading tip bristles. This group 34 is preferably comprised of two or more tufts.

Figure 2:
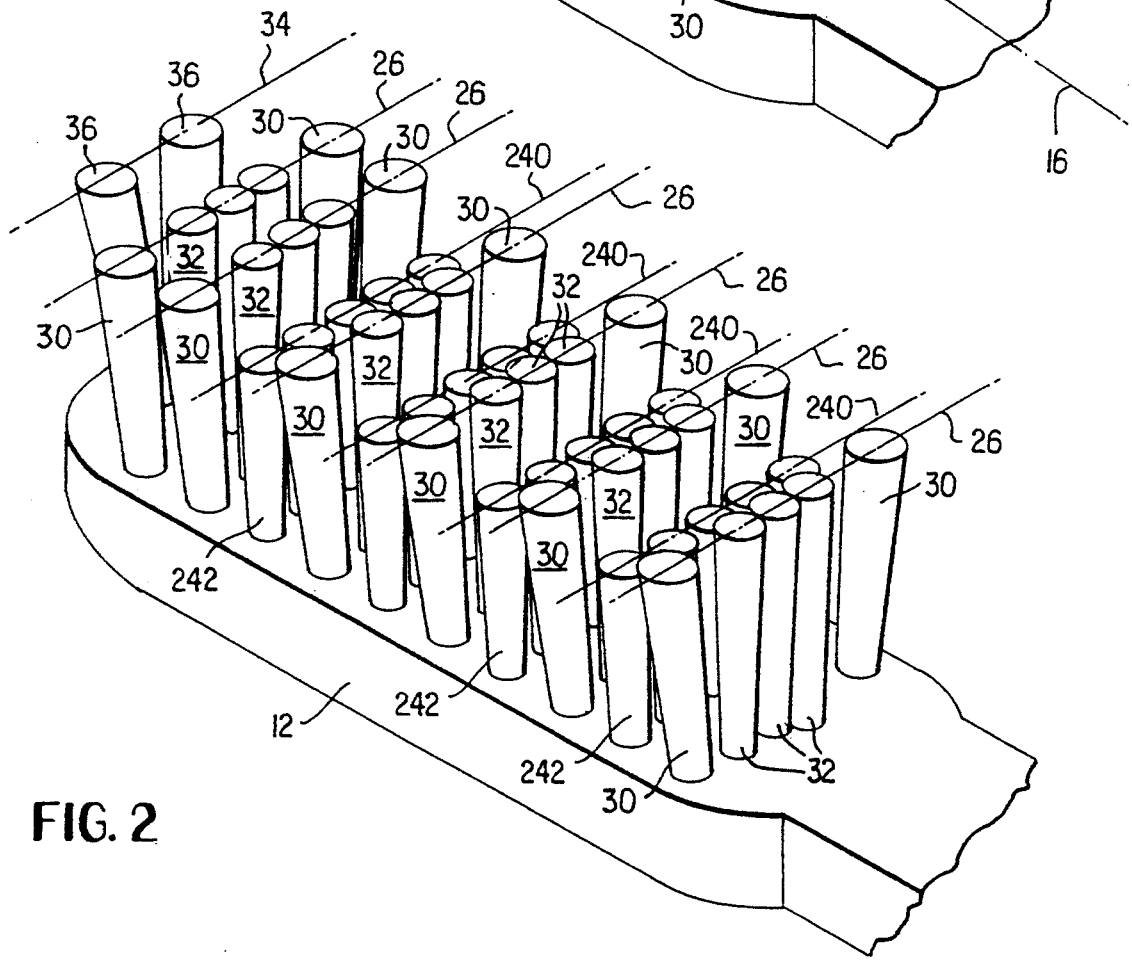
FIG. 2 is a partial perspective view of a toothbrush formed in accordance with a second embodiment of this invention.

Referring now to FIG. 2 of the drawings, the construction is the same as that shown in FIG. 1, except that the wide bristle bar tufts 25, each of which defines a row 24, are each replaced by a row 240 defined by individual round tufts 242. Rows 240 of tufts 242, as the tufts in the other rows 26, 24 and 34 of FIG. 1, are aligned transversely to axis 16 and are longitudinally spaced therealong.

The construction of rows 24 of FIG. 1 entails forming relatively wide transverse grooves in head 12 for receiving the bottom ends of the bristles which define each bristle bar tuft 25. This can be done manually. If currently available automated machinery is used to form such wide grooves, certain problems arise in filling the grooves and in maintaining the bristles in each bristle bar at their desired perpendicular relation to head surface 14.

To overcome these problems, transverse rows each of closely spaced generally round holes are formed on surface 14, instead of a wide groove, as shown in FIG. 2. Individual rounded tufts 242 are then, by automatic machinery currently available, inserted and fixed into these holes. The result yields rows 240 nearly identical to rows 24, with individual tufts 242 in close laterally spaced relation to each other.

It will be observed that the arrangement of rows in both embodiments is such that rows 24 and 26 (as well as rows 240 and 26) alternate along axis 16, except that two rows 26 are next to row 34. Thus, there are at this region of the head two rows 26 adjacent each other as measured along longitudinal axis 16 of head 12. The tufts of rows 26 are preferably each of the same height and, as noted above, their height as measured vertically is greater than that of the tufts of rows 24. Typically, the height of the bristles in first group 24 is about 8.5 mm, while the height (as measured vertically) of the bristles of the tufts in the second and third groups 26 and 34 is typically about 10.5 mm. The longest tufts are those in group 34, with the next longest being tufts 30. The vertical height, however, of tufts 30 and 34 is the same as measured from the head surface 14. The spacing between rows 24 (240) 26, 30, 32 and 34 is typically about 0.09 inches, as measured at the bottom of the tufts.

In the embodiment of FIG. 1, the lateral spacing between tufts 32 is about 0.06 inches and the lateral spacing between tufts 30 of any group 26 is about 0.28 inches. The length of single tufts 25 is about 0.34 inches and their thickness is about 0.06 inches. The lateral spacing between tufts 36 is about 0.070 inches. The base diameter of tufts 36 and 30 is about 0.050 inches to about 0.060 inches. The base diameter of tufts 32 is about 0.040 inches.

In the embodiment of FIG. 2, the lateral spacing between tufts 32 is about 0.065 inches and the lateral spacing between tufts 30 of any row 26 is about 0.312 inches. The lateral spacing between tufts 242 is about 0.065 inches and that between tufts 36 is typically about 0.092 inches. The base diameter of all of the tufts is about 0.050 inches to about 0.060 inches.

Referring to FIGS. 3 to 6 and their respective counterparts FIGS. 3*a* to 6*a*, the specific cleaning function of the tufts of the embodiment of FIG. 1 is illustrated. The several groups are highlighted by vertical hatching at FIGS. 3 to 6. In this description, the tufts are described and grouped as to the functions they perform, while the previous description has described the tufts solely as to the several rows they define.

Figure 3:
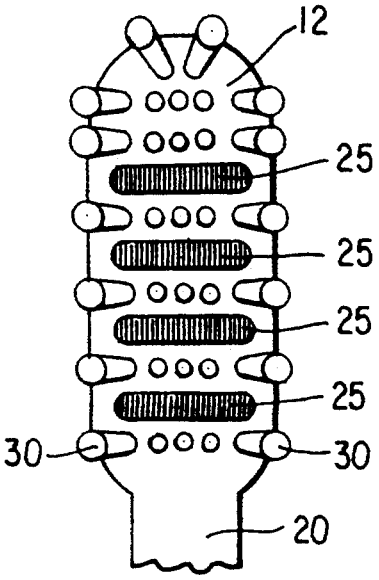
FIGS. 3 to 6 are plan views of the toothbrush of FIG. 1 and illustrate, with respective FIGS. 3*a* to 6*a*, the function of the several groups of tufts and their contact with teeth T and gums denoted as G.
Figure 4:
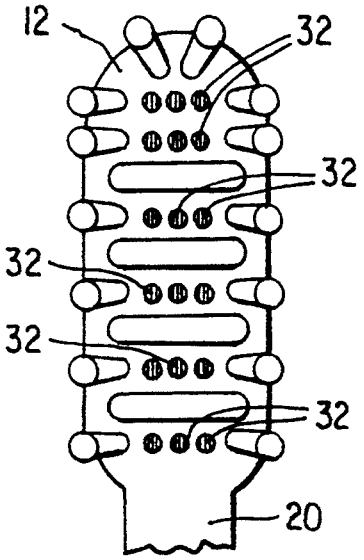
Figure 3A:
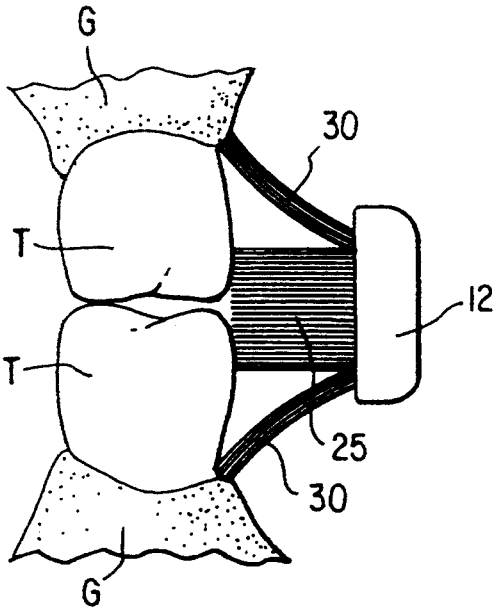
Figure 4A:
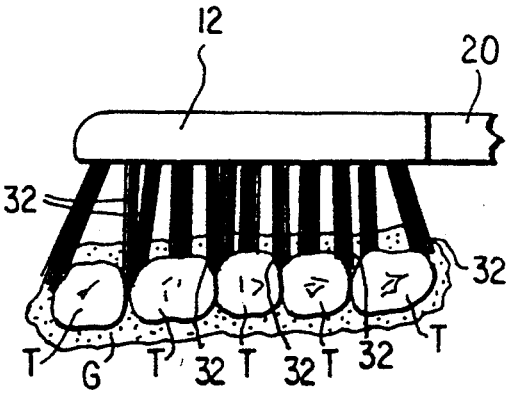

At FIGS. 3 and 3*a*, bristle bars 25 clean the broad surfaces of the teeth with centrally located bristle packs that maximize the cleaning contact to the teeth. The shorter length of these bristles brings them into contact with the surfaces of the teeth as the longer interproximal bristles 32 (as shown in FIG. 4 and 4*a*) enter the crevices between the teeth. Tufts 32 and 36 are omitted from FIG. 3*a* for purposes of clarity. Conventional toothbrushes do not concentrate bristle density or tuft density to such a degree, with the result that less cleaning than is desirable is accomplished on the broad tooth surfaces.

At FIGS. 4 and 4a, the long, centrally located interproximal tufts of bristles 32 reach into the crevices between teeth. These bristle tufts are spaced to allow deep cleaning access. The specific placement pattern of these tufts allows for dynamic and independent cleaning action. Convention toothbrushes have bristles of the same length and density that tend to structurally support each other, acting as a single block and preventing the dynamic, independent action required for multi-task cleaning.

Figure 5:
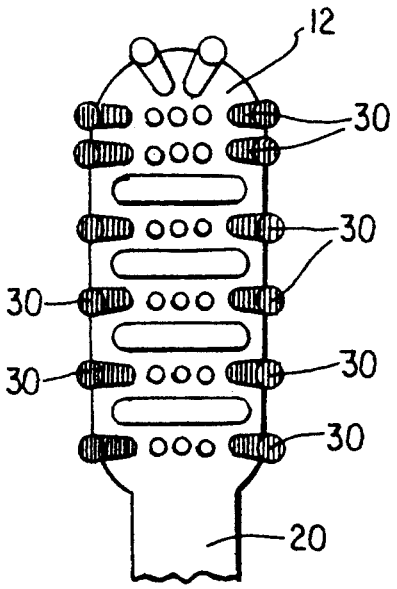
Figure 5A:
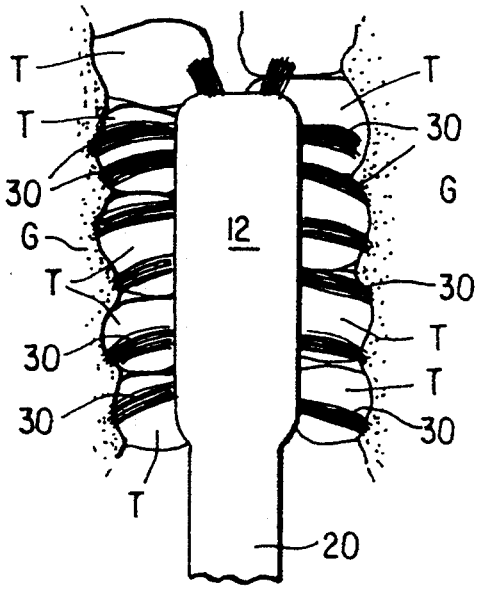

At FIG. 5 and 5a, long flexible bristles 30 line each side of the brush head 12 and are angled outwardly to gently sweep plaque from the teeth at the gumline and from in between teeth. The intentional outward angle results in a soft, controlled bristle action aimed at the gumline. Conventional toothbrushes have vertical bristles whose flexing is not controlled or directed towards the gumline. Conventional vertical bristles can cause damage to the soft gum tissue.

Figure 6:
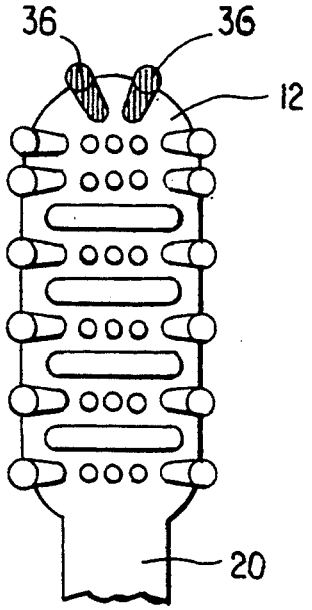
Figure 6A:
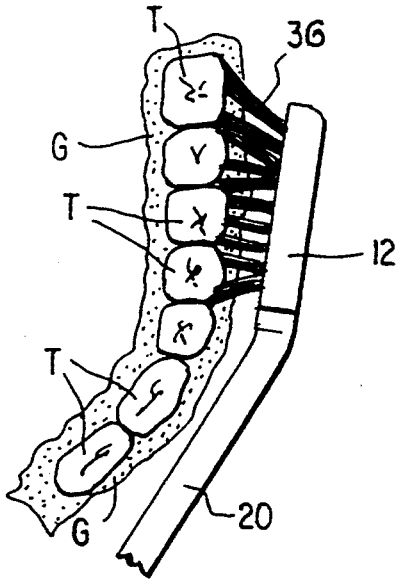

At FIGS. 6 and 6a, leading tip tufts of bristles 36 at the tip of the brush head are angled forward to ensure that the cleaning action reaches the teeth at the back of the mouth and cleans in between teeth. Additionally, they clean the lingual surfaces and the sulcus areas of the front teeth. Vertical bristles limit the access of conventional toothbrushes to the back of the mouth where plaque continues to accumulate.

There are thus four functional groups of tufts in head 12. There are the bristle bar group defined by tufts 25, 242 and 246 for cleaning broad surfaces of the exposed sides of teeth, the interproximal bristle group defined by tufts 32 for cleaning the crevices between teeth, the gumline bristle group defined by tufts 30 for cleaning teeth at the gumline, and the leading tip bristles group defined by tufts 36 which ensures cleaning of teeth in the back of the mouth.

Figure 7:
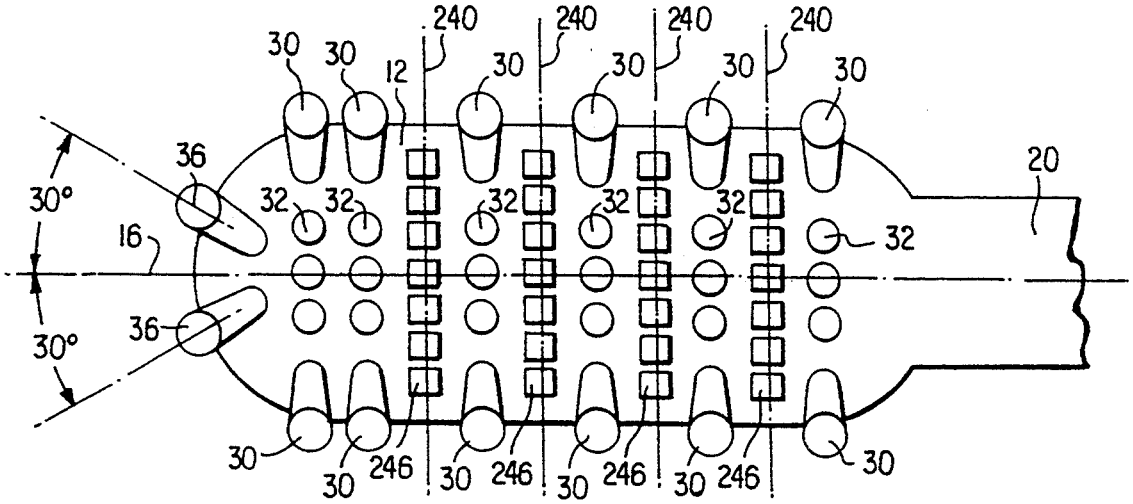
FIG. 7 is a top plan view of a modified version of the toothbrush of FIG. 2.

In the embodiment of FIG. 7, the five generally round tufts 242 in each of rows 240 of FIG. 2 are replaced by a greater number of quadrangular tufts 246 which are preferably rectangular. In all other respects, the bristle/tuft configuration and dimensions are the same. Each quadrangular tuft preferably should be of about the same area as the round holes in head 12 which receive generally round tufts 242 of FIG. 2. These tufts can also be square in shape but when not square in shape, the smaller dimension of each tuft 246 preferably is along each row 240, i.e., is perpendicular to axis 16. The change from a generally round to a quadrangular tuft cross section, with these dimensions of each quadrangle, permits seven quadrangular tufts 246 in each row instead of five round tufts 242, with only slight row lengthening. The cross-sectional area of each round tuft 242 is the same as the cross-sectional area of each quadrangular tuft 246, but the tuft dimension along row 240 is smaller with a rectangular shaped tuft, the preferred shape, hence the greater number of bristles in a row 240 of rectangular tufts. Another advantage of the rectangular tuft shape is that it more nearly approximates the bristle bars 25 of FIG. 1 in the number of individual bristles in each row 240. Namely, the number of bristles in each row 240 of FIG. 7 is greater than the number of bristles in each row 240 of FIG. 2.

In the embodiment of FIG. 7, the lateral spacing between tufts 32 is about 0.65 inches and the lateral spacing between tufts 30 is about 0.312 inches. The lateral spacing between tufts 246 is about 0.054 inches and that between tufts 36 is about 0.092 inches. The shortest dimension of each rectangular tuft 246 is about 0.039 inches and its longest dimension is about 0.05 inches.

In FIG. 7, the longest dimension of each rectangular tuft 246 is parallel to axis 16. If desired, rectangular tufts 246 of any row 240, or of all the rows 240, may be rotated 90 degrees so that the longest dimension of each rectangular tuft is perpendicular to axis 16. To preserve required intertuft spacing along any row 240, it may be necessary to omit one of the tufts 246, so that any row 240 would contain only six of the rectangular tufts.

Figure 8:
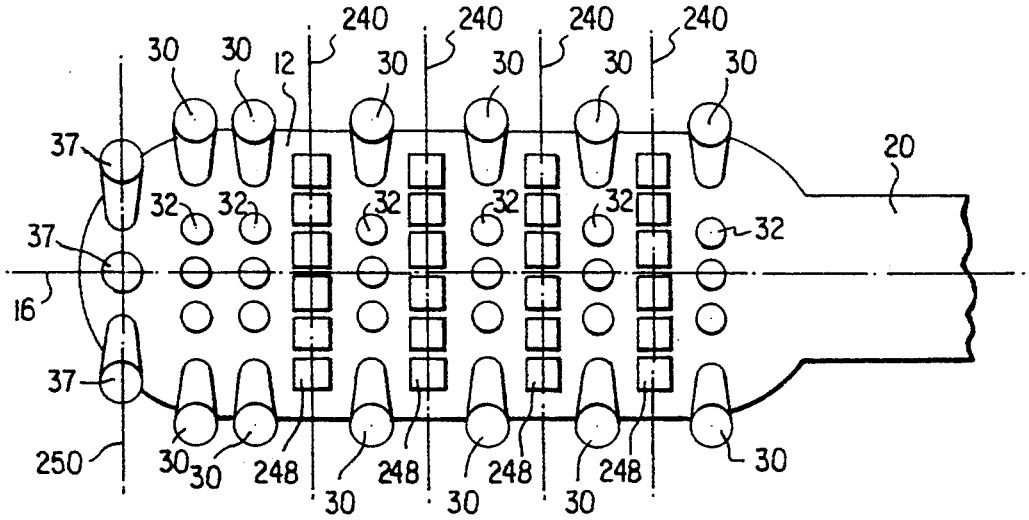
FIG. 8 is a top plan view of a modification of the toothbrush of FIG. 7.

Referring now to the embodiment of FIG. 8, the construction is similar to that shown in FIG. 7, also utilizing rectangular polygonal tufts. The differences relate to the tuft sizes and spacing, to be later given, and to those tufts at the free end of the head, i.e., remote from the handle. In the embodiments previously described, two tufts 36 are located nearest the head free end, with each tuft tilted both forwardly (away from the handle) and laterally outwardly, away from the head center along axis 16. In the FIG. 8 embodiment, the two forwardmost tufts 36 are replaced by three tufts 37 arranged in a single transverse row 250, the latter parallel to transverse rows 240. Each tuft 27 is of the same size. The middle tuft is centrally located on the tuft head 12, coincident with axis 16, and is perpendicular to the brush head. The two outermost tufts 37 tilt laterally outwardly at about 12 degrees from the vertical. These tufts can also tilt forwardly as do tufts 36 with regard to the embodiment of FIG. 7. The tufts 37 each lie in a plane transverse to axis 16. Tufts 37 perform a function similar to that of tufts 36.

In the embodiment of FIG. 8, the longitudinal spacing (as measured along axis 16) between the transverse rows of tufts is 0.10 inch. The spacing between the tuft receiving openings in the brush head, as measured along each transverse row, is about 0.015 inch. The diameter of the brush head openings which receives the round tufts is about 0.06 inch. The shortest dimension of each rectangular tuft 248 is about 0.047 inch, while the longest dimension is about 0.060 inch. The rectangular tufts of FIG. 8 are each denoted as 246.

In FIG. 8, as in the embodiment of FIG. 7, the longest dimension of each rectangular tuft is parallel to axis 16. If desired, rectangular tufts 248 of any row 240, or of all the rows 240, may be rotated 90 degrees, so that the longest dimension of each rectangular tuft 248 is perpendicular to axis 16. To preserve required intertuft spacing along any row 240, it may be necessary to omit one of the tufts 248.

The head of the embodiment of FIG. 8 is about 0.1 inch longer than the head of the embodiment of FIG. 7, while its width is about 0.030 inches wider. The diameter of tufts 32 and 37 may be the same or may differ. Preferably, they are of the same diameter.

We claim:

1. A toothbrush head having a handle attached thereto, the head having a longitudinal axis and terminating in a free end remote from said handle, the head having a surface from which tufts of bristles extend generally upwardly, the tufts on the peripheral edge of the head tilting laterally outwardly at an angle from the vertical, the tufts being arranged in three groups of rows wherein each row is transverse to said longitudinal axis, the tufts of each row of the first group being shorter in height than those in the other rows, the tufts of each row of the second group so arranged that the endmost tuft in each row thereof tilts laterally outwardly toward a respective side of the head and the remaining tufts of each second row extend substantially perpendicularly to said head surface, some of said first and second groups alternating with each other along the longitudinal axis of the head, said third group of tufts located nearest said head free end and including two endmost tufts each tilting laterally outwardly toward a respective side of the head.

2. The toothbrush head of claim 1 wherein the tufts of said second and third groups are of the same height as measured vertically.

3. The toothbrush head of claim 1 wherein each said tuft of said third group of tufts tilts forwardly at an angle of about 14 degrees from the vertical and laterally outwardly about 30 degrees from the vertical.

4. The toothbrush head of claim 1 wherein a row of said second group of tufts is nearer to said handle than any other row of any group.

5. The toothbrush head of claim 1 wherein each of the endmost tufts of said second group of tufts tilts laterally at about 12 degrees to the vertical.

6. The toothbrush head of claim 1 wherein each row of said first group of tufts comprises a single tuft of a width substantially spanning the width of said head.

7. The toothbrush head of claim 1 wherein each row of said first group of tufts comprises a plurality of tufts which together substantially span the width of said head, said first group of tufts being laterally spaced from each other.

8. The toothbrush head of claim 1 wherein each tuft in said first group is generally round.

9. The toothbrush head of claim 1 wherein each tuft in said first group is quadrangular.

10. A toothbrush head having a handle attached thereto, the head having a longitudinal axis and terminating in a free end remote from said handle, the head having a surface from which tufts of bristles extend generally upwardly, the tufts defining (1) a bristle bar group of tufts for cleaning the broad surfaces of the teeth, said bristle bar group defined by transversely extending, longitudinally spaced rows of densely packed bristles with each row extending across a portion of the width of the head, and located widthwise substantially medially of the head, said bristle bar tufts being shorter than those of any other group, (2) an interproximal group of longitudinally spaced apart bristle tufts for cleaning crevices between teeth and defined by longitudinally spaced rows having laterally spaced tufts and located substantially medially of the head (3) a gumline bristle group of spaced apart tufts for cleaning teeth at the gumline defined by a plurality of tufts substantially around the head periphery, each said gumline tuft tilting laterally outwardly (4) a leading tip group having spaced apart tufts for cleaning the teeth at the back of the mouth, said latter group including at least two tufts each of which tilt laterally outwardly toward a respective opposite side of the head and which are located nearest the free end of the head.

11. The toothbrush head of claim 10 wherein said bristle bar group of tufts is defined by a single tuft.

12. The toothbrush head of claim 10 wherein said bristle bar group of tufts is defined by closely spaced tufts.

13. The toothbrush head of claim 10 wherein said interproximal tufts and said gumline tufts are in the same rows transverse to said longitudinal axis.

14. The toothbrush head of claim 10 wherein most of said bristle bar tufts and said interproximal tufts alternate in transverse rows along the longitudinal axis of the head.

15. The toothbrush head of claim 10 wherein two rows of said interproximal tufts are transverse to said longitudinal axis, and are adjacent themselves along the longitudinal axis of the head.

16. The toothbrush head of claim 10 wherein said leading tip group of tufts are in a single row, transverse to said longitudinal axis, said row being most remote from the handle.

17. The toothbrush head of claim 10 wherein said leading tip group includes both said two tufts and a third tufts, the third tuft being located between said two laterally tilting tufts and extending perpendicularly to said head surface, said two tilting tufts and said third tuft lying in a plane transverse to said head longitudinal axis.

18. The toothbrush head of claim 17 wherein said two tilting tufts each tilt at about 12 degrees from the vertical.

19. A toothbrush head having a handle attached thereto, the head having a longitudinal axis and terminating in a free end remote from said handle, the head having a surface from which tufts of bristles extend generally upwardly, the tufts on the peripheral edge of the head tilting laterally outwardly at an angle from the vertical, the tufts being arranged in three groups of rows of tufts wherein each row is transverse to said longitudinal axis, the tufts of each row of the first group being shorter in height than those in the other rows, the tufts of each row of the second group so arranged that the endmost tuft in each row thereof tilts laterally outwardly toward a respective side of the head and the remaining tufts of each second row extend substantially perpendicular to said head surface, some of said first and second groups alternating with each other along the longitudinal axis of the head, said third group of tufts located nearest said head free end and including two endmost tufts each tilting laterally outwardly toward a respective side of the head, said third group of tufts including both said two endmost tufts and a third tuft, the third tuft being located between said laterally tilting, two endmost tufts and extending perpendicularly to said head surface, said two endmost tilting tufts and said third endmost tuft lying in a plane transverse to said head longitudinal axis, said two endmost tufts located on opposite sides of said longitudinal axis.

20. The toothbrush of claim 19 wherein said two tilting tufts of said third group each tilt at about 12 degrees from the vertical.

21. The toothbrush of claim 19 wherein there are four rows in said first group.

22. The toothbrush of claim 19 wherein there are six rows in said second group, two of said rows of said second group being next adjacent and being located next to said third group of tufts.

23. The toothbrush of claim 19 wherein there are six tufts in each row of said first group of rows.

24. The toothbrush of claim 19 wherein there are five tufts in each row of said second group of rows.

25. The toothbrush head of claim 10 wherein said bristle bar group of tufts is defined by six tufts.

26. The toothbrush head of claim 10 wherein said interproximal group of tufts is defined by three tufts.

27. The toothbrush of claim 10 wherein said gumline group of tufts is defined by longitudinally spaced rows each of which is defined by two tufts.

28. The toothbrush head of claim 10 wherein said leading tip group of tufts is defined by three tufts in a single row transverse to said toothbrush longitudinal axis.

29. A toothbrush head having a handle, the head having a surface, the head having a longitudinal axis and terminating in a free end remote from said handle, tufts of bristles extending generally upwardly from said head surface, the tufts arranged in a plurality of groups of rows wherein each row is transverse to said longitudinal axis, the tufts of each row of a first group being shorter in height than those of the other rows, the tufts in each row of a second group so arranged that the endmost tufts thereof each tilt laterally and the remaining tufts of each row of the second group extend substantially perpendicularly to said head surface, the tufts of said second group being of the same height, some of said first and second groups alternating along the longitudinal axis of the head.

30. A toothbrush head having a handle, the head having a longitudinal axis and terminating in a free end remote from said handle, tufts of bristles extending generally upwardly from said head surface, the tufts being arranged in a plurality of rows of tufts wherein each row is transverse to said longitudinal axis, the tufts of each row of a first group being shorter in height than those in the other rows, a second group of tufts located nearest said head free end and including two endmost tufts each tilting laterally outwardly toward a respective side of the head, said second group of tufts also including a third tuft extending perpendicularly to said head and midway of said two endmost tufts of said second group, the tufts of said second group lying in a plane.

31. A toothbrush head having a handle, the head having a longitudinal axis and terminating in a free end remote from said handle, tufts of bristles extending generally upwardly from said head surface, the tufts arranged in a plurality of groups of rows of tufts wherein each row is transverse to said longitudinal axis, the tufts of each row of a first group so arranged that the endmost tuft in each row thereof tilts laterally outwardly toward a respective side of the head and the remaining tufts of each first group of rows extend substantially perpendicularly to said head surface, the tufts of said first group being of the same height, a second group of tufts located nearest said head free end and including two endmost tufts each tilting laterally outwardly toward a respective side of the head, said second group of tufts also including a third tuft extending perpendicularly to said head and midway of said two endmost tufts of said second group, the tufts of said second group lying in a plane.

32. A toothbrush head having a handle, the head having a longitudinal axis and terminating in a free end remote from said handle, the head having a surface from which tufts of bristles extend generally upwardly, the tufts defining (1) a bristle bar group of tufts for cleaning the broad surfaces of the teeth, said bristle bar group defined by transversely extending, longitudinally spaced rows of densely packed bristles with each row extending across a portion of the width of the head, and located widthwise substantially medially of the head, said bristle bar tufts being shorter than those of any other group, (2) an interproximal group of longitudinally spaced apart bristle tufts for cleaning crevices between teeth and defined by longitudinally spaced rows having laterally spaced tufts and located substantially medially of the head (3) a gumline bristle group of spaced apart tufts for cleaning teeth at the gumline defined by a plurality of tufts substantially around the head periphery, each said gumline tuft tilting laterally outwardly.

33. A toothbrush head having a handle, the head having a longitudinal axis and terminating in a free end remote from said handle, the head having a surface from which tufts of bristles extend generally upwardly, the tufts defining (1) a bristle bar group of tufts for cleaning the broad surfaces of the teeth, said bristle bar group defined by transversely extending, longitudinally spaced rows of densely packed bristles with each row extending across a portion of the width of the head, and located widthwise substantially medially of the head, said bristle bar tufts being shorter than those of any other group, (2) an interproximal group of longitudinally spaced apart bristle tufts for cleaning crevices between teeth and defined by longitudinally spaced rows having laterally spaced tufts and located substantially medially of the head (3) a leading tip group having spaced apart tufts for cleaning the teeth at the back of the mouth, said latter group including at least two tufts each of which tilt laterally outwardly toward a respective opposite side of the head and which are located nearest the free end of the head.

34. A toothbrush head having a handle, the head having a longitudinal axis and terminating in a free end remote from said handle, the head having a surface from which tufts of bristles extend generally upwardly, the tufts defining (1) a bristle bar group of tufts for cleaning the broad surfaces of the teeth, said bristle bar group defined by transversely extending, longitudinally spaced rows of densely packed bristles with each row extending across a portion of the width of the head, and located widthwise substantially medially of the head, said bristle bar tufts being shorter than those of any other group, (2) a gumline bristle group of spaced apart tufts for cleaning teeth at the gumline defined by a plurality of tufts substantially around the head periphery, each said gumline tuft tilting laterally outwardly (3) a leading tip group having spaced apart tufts for cleaning the teeth at the back of the mouth, said latter group including at least two tufts each of which tilt laterally outwardly toward a respective opposite side of the head and which are located nearest the free end of the head.

* * * * *